US005447430A

United States Patent [19]

Kim et al.

[11] Patent Number: 5,447,430

[45] Date of Patent: Sep. 5, 1995

[54] COLORED FLUID PYROPHORIC DEVICE

[76] Inventors: Heung C. Kim; Kyung H. Gahm, both of 1407 Kewalo St. #27, Honolulu, Hi. 96822

[21] Appl. No.: 199,741

[22] Filed: Feb. 22, 1994

[51] Int. Cl.[6] ..... F23Q 2/32

[52] U.S. Cl. ..... 431/126; 431/13; 431/277

[58] Field of Search ..... 431/13, 126, 254, 276, 431/277

[56] References Cited

U.S. PATENT DOCUMENTS 3,154,935 11/1964 Ayres ..... 431/277

FOREIGN PATENT DOCUMENTS 57-184830 11/1982 Japan ..... 431/126

*Primary Examiner*—Carroll B. Dority
*Attorney, Agent, or Firm*—Michael I. Kroll

[57] ABSTRACT

Briefly, the invention comprises a pressurized butane or naphtha lighter with a clear plastic butane or naphtha reservoir. The butane or naphtha is colored by special dyes to lend attractiveness to the device. The use of colored butane or naphtha instead of colored plastic butane or naphtha reservoirs gives the color a dynamically changing aspect. As the transparent lighter case is moved about the colored butane or naphtha flowing within forms a particularly beautiful effect. Butane or naphtha coloring agents and proportions have been developed which allow the creation of a wide range of hues and shades without adversely effecting the flammability of the raw butane or naphtha.

5 Claims, 1 Drawing Sheet

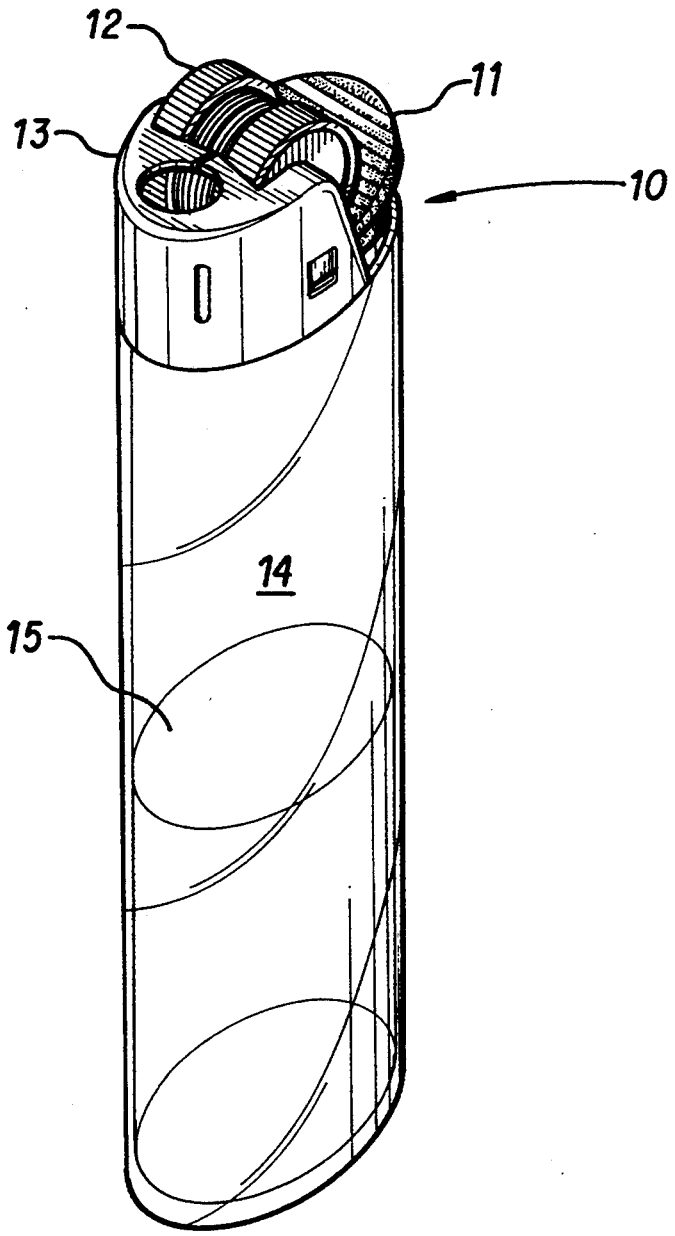
12
11
13
10
14
15

COLORED FLUID PYROPHORIC DEVICE

BACKGROUND OF THE INVENTION

1. Field of the Invention

The present invention relates to pyrophoric devices. More specifically it relates to portable ignition devices in the form of hand held torches. Even more specifically, it relates to an improved clear plastic cigarette lighter case with colored butane or naphtha used both as the combustible agent and the decorative feature. In its greatest specificity, this invention relates to means for coloring the combustible fluid commonly used in these cigarette lighters. Throughout this specification the commonly used term "cigarette lighter" is used to refer to portable pyrophoric devices in accordance with common terminology. The term is in no way intended to limit the potential uses of the device described herein to the lighting of cigarettes. Common commercially available cigarette lighters of this type, although taken for granted by many, are the product of many sophisticated technological advances.

The type of cigarette lighter which this invention improves upon is the commonly available plastic liquid butane or naphtha tank with an attached flint wheel type igniter and manually operated gas release valve. Any application requiring a portable source of concentrated heat or light is capable of being performed by these little cigarette lighters. Although most commonly used as cigarette lighters many craftsman, artisans, and mechanics have discovered a myriad of uses for the inexpensive throw-away pyrophoric torches that are sold by the millions.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

In general the coloring of flammable liquids is old. This has been done for both identification and safety purposes. However, flammable liquids which must be maintained under pressure have not generally been colored in this manner. The pressure vessels in which these pressurized liquids are stored are usually color coded.

Devices for lighting cigarettes which employ a liquid reservoir are old and well known in the art. Many of the earlier forms of these held a reservoir of unpressurized naptha which was employed to wet a wick in contact with the atmosphere for sustaining combustion. Eventually, portable reservoirs containing pressurized liquid butane or naphtha were developed. Butane or naphtha liquid is colorless. Recently, advances in the development of plastics with sufficient tensile strength to withstand internal pressurization have led to the introduction of cheap, attractively colored lighters. In accordance with conventional terminology, the term "lighter" used herein may be taken to mean any portable pyrophoric device. The plastic lighters of today are so inexpensive that they may be sold as throw-away items which are simply discarded when their fuel is spent. However, the colored plastic lighter still suffers from some significant disadvantages.

The first major disadvantage in colored plastic lighters is that the addition of coloring pigment to the plastic weakens the plastic significantly. This weakness must be compensated for by construction of complex internal reinforcement of the pressure chamber to prevent rupture and explosion during normal use. Therefore, the laudible objective of low cost must be traded off for the objective of attractive coloring.

The second major disadvantage of colored plastic lighters is that the pressure reservoir walls, weakened by the color pigmentation, must be made thick to minimize the mechanical stress. Thick colored plastic is opaque. It is not possible to see the amount of fuel remaining in a reservoir with opaque walls. It has not been possible to make a colored plastic of this thickness and achieve transparency or even translucency.

The following known prior art has been directed to providing transparent walls on lighter reservoirs for easily viewing remaining fuel and/or adding some form of coloring to the device. As will be seen, the simplicity and effectiveness of my invention is not rivaled in the prior art.

U.S. Pat. No. 2,986,027, issued to Lockwood on May 30, 1961, and U.S. Pat. No. 2,580,499, issued to Adams on Jan. 1, 1952, show standard unpressurized naptha lighters with transparent reservoir bodies. The concept of coloring the lighter is not contemplated. Contrast this with my invention where a transparent plastic reservoir is filled with colored butane or naphtha under pressure.

United Kingdom Patent No. UK 593,146, issued to Rose on Oct. 9, 1947, shows an unpressurized naptha lighter with a transparent fluid reservoir. The internal wicking mechanism consists of a colored cotton yarn to impart color to the device. By contrast, the device of the instant invention uses pressurized butane or naphtha which itself is colored to impart color to the device which is dynamic in nature.

Japanese Patent Nos. 56-68272 and 57-204726, issued to Iwabori November 13 and December 12, respectively, teach coloring butane or naphtha within transparent plastic lighters with oil dyes dissolved in aromatic compounds such as benzene. These oil dyes are known to significantly degrade the flammability of the butane or naphtha. By contrast, the device of the instant invention uses special compounds designed especially to enhance the flammability of the butane or naphtha and also easily provide a host of coloring possibilities.

None of the above inventions and patents, taken either singly or in combination, is seen to describe the instant invention as claimed.

SUMMARY OF THE INVENTION

Briefly, the invention comprises a pressurized butane or naphtha lighter with a clear plastic butane or naphtha reservoir. The butane or naphtha is colored by special dyes to lend attractiveness to the device. The use of colored butane or naphtha instead of colored plastic butane or naphtha reservoirs gives the color a dynamically changing aspect. As the transparent lighter case is moved about the colored butane or naphtha flowing within forms a particularly beautiful effect. Butane or naphtha coloring agents and proportions have been developed which allow the creation of a wide range of hues and shades without adversely effecting the flammability of the raw butane or naphtha.

Accordingly, it is a principal object of the invention to provide a new and improved colored pyrophoric device which overcomes the disadvantages of the prior art in a simple but effective manner.

It is a major object of this invention to provide a pressurized butane or naphtha lighter with a transparent plastic reservoir which contains colored butane or naphtha for a dynamic visual effect.

It is a major object of this invention to provide a pressurized butane or naphtha lighter with a transparent plastic reservoir which is stronger than colored plastic counterparts and which still appears colored because of the colored butane or naphtha.

It is a major object of this invention to provide a pressurized butane or naphtha lighter with a transparent plastic reservoir which is stronger than colored plastic counterparts and therefore can be manufactured with thinner walls and no internal reinforcement structure.

It is another object of the invention to provide a minimal number of coloring chemicals which can be mixed in various proportions to create virtually any color imaginable.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWING

Various other objects, features, and attendant advantages of the present invention will become more fully appreciated as the same becomes better understood when considered in conjunction with the accompanying drawing wherein:

The FIGURE is a perspective view of a cigarette lighter constructed in accordance with the invention.

DETAILED DESCRIPTION OF THE PREFERRED EMBODIMENT

The colored pyrophoric device of the present invention is generally designated by arrow 10 of the FIGURE. The device comprises the following main parts; manual gas valve 11, flint wheel assembly 12, wind shield assembly 13, clear plastic butane or naphtha reservoir 14, and colored butane or naphtha liquid 15.

The operating mechanism 11, 12, and 13 shown in the FIGURE is illustrative of a commercial lighter. Transparent butane or naphtha reservoir 14 and colored butane or naphtha 15, however, are novel and uniquely different from prior art.

Reservoir 14 is made from a clear, rigid plastic having high tensile strength to be able to withstand the internal pressure which liquifies the enclosed butane or naphtha. Although it is preferred to have the reservoir free of external apertures and protrusions, it is recognized that a butane or naphtha pressure fitting could be provided on the bottom surface if a refillable lighter were desired. Reservoir 14 also differs from prior art in that it has smooth internal walls and an overall substantially constant exterior wall thickness. This is possible because of the substantially stronger clear plastics that are commercially available as opposed to the weaker colored versions. The extra strength of the clear plastic allows the omission internal reinforcement ridges, bosses, or flanges of any kind. This, in turn, allows the internal wall shape to be congruent and parallel to the external wall shape, thus further enhancing the clean and attractive appearance of the device without sacrificing any utility of function.

Turning now to the liquid butane or naphtha 15 in the reservoir, the dyes for creating the coloring of the butane or naphtha will be disclosed. We have found the following chemicals to be suitable for dying either liquid butane gasoline or naptha without sacrificing the flammable characteristics. Essentially, seven compounds have been found suitable for this application with one or more of the essential seven being used to create the desired coloring. The seven dye compounds are:

bicyclo[5.3.0]-deca-2,4,6,8,10-pentaene (I);
1,4-dimethyl-7-(1-methylethyl)azulene (II);
1,4-di-p-toluidinoanthraquinone (III);
1-[2,5-dimethyl-4-(2,5-dimethylphenylazo)-phenylazo]-2-naphthol (IV);
1-phenylazo-2-naphthalenamine (V);
1-[(2-methylphenyl)azo]-2-naphthalenamine (VI); and
Sudan black B. (VII).

To obtain various fundamental colors of liquid butane or naphtha the following procedures are recommended:

Blue—200 mg of (I) or (II) is dissolved in 1 kg of liquid butane or naphtha;

Blue—(alternate method) 100 mg of (III) is dissolved in 1 kg of liquid butane or naphtha;

Red—92.3 mg of (IV) is dissolved in 1 kg of liquid butane or naphtha;

Yellow—62 mg of (V) is dissolved in 1 kg of liquid butane or naphtha;

Yellow—(alternate method) 62 mg of (VI) is dissolved in 1 kg of liquid butane or naphtha;

Violet—76 gm of (VII) is dissolved in 1 kg of liquid butane or naphtha;

Orange—6.92 mg of (IV) and 14,8 mg of (V) is dissolved in 1 kg of liquid butane or naphtha;

Green—118 mg of (II) and 5.4 mg of (V) is dissolved in 1 kg of liquid butane or naphtha;

Brown—111 mg of (II), 5.2 mg of (V), and 4.4 mg of (IV) is dissolved in 1 kg of liquid butane or naphtha;

Purple—92.5 mg of (II) and 1.3 mg of (IV) is dissolved in 1 kg of liquid butane or naphtha;

Black—311 mg of (II), 7.3 mg of (IV), and 5.2 mg of (V) is dissolved in 1 kg of liquid butane or naphtha;

The following are examples of the coloring agents used in accordance with the present invention:

1. About 6.92 parts per million of 1-[2,5-dimethyl-4-(2,5-dimethylphenylazo)phenylazo]-2-naphthol and about 14.8 parts per million of 1-phenylazo-2-naphthalenamine (V).

2. About 118 parts per million of 1,4-dimethyl-7-(1-methylethyl) azulene and about 5.4 parts per million of 1-phenylazo-2-naphthalenamine.

3. About 1,4-dimethyl-7-(1-methylethyl)azulene, about 5.2 parts per million of 1-phenylazo-2-naphthalenamine, and about 4.4 parts per million of 1-[2,5-dimethyl-4-(2,5-dimethylphenylazo)phenylazo]-2-naphthol.

4. About 92.5 parts per million of 1,4-dimethyl-7-(1-methylethyl)azulene and about 1.3 parts per million of 1-[2,5-dimethyl-4-(2,5-dimethylphenylazo)phenylazo]-2-naphthol.

5. About 311 parts per million of 1,4-dimethyl-7-(1-methylethyl)azulene, about 7.3 parts per million of 1-[2,5-dimethyl-4-(2,5-dimethylphenylazo)phenylazo]-2-naphthol and about 5.2 parts per million of 1-phenylazo-2-naphthalenamine.

As will be obvious to the artisan mixtures of the above colors will produce colors of their own and it is possible to produce an unlimited variety of colors.

A list of reference numerals for the preferred embodiment of the present invention follows:

10 general pyrophoric device
11 manual gas valve
12 flint wheel assembly
13 wind shield assembly
14 clear plastic case
15 colored butane or naphtha liquid It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily ascertain that the colored butane or naphtha in a transparent tank concept could be extended to larger butane or naphtha tanks used for small blow torches in the plumbing trade.

It is to be understood that the present invention is not limited to the sole embodiment described above, but encompasses any and all embodiments within the scope of the following claims:

I claim:

1. A device consisting of a gas operated cigarette lighter comprising:

a transparent reservoir for containing a pressurized liquid and gaseous fuel selected from the group consisting of naphtha and butane;

hand operated valve means for controllably allowing gaseous fuel to escape to the atmosphere;

ignition means for beginning combustion of said escaping gaseous fuel;

coloring means for said liquid fuel within said transparent reservoir which does not adversely effect the combustion of said gaseous, said coloring means comprising about 6.92 parts per million of 1-[2,5-dimethyl-4-(2,5-dimethylphenylazo)-phenylazo]-2-naphthol and about 14.8 parts per million of 1-phenylazo-2-naphthalenamine (V).

2. A device consisting of a gas operated cigarette lighter comprising:

a transparent reservoir for containing a pressurized liquid and gaseous fuel selected from the group consisting of naphtha and butane;

hand operated valve means for controllably allowing gaseous fuel to escape to the atmosphere;

ignition means for beginning combustion of said escaping gaseous fuel;

coloring means for said liquid fuel within said transparent reservoir which does not adversely effect the combustion of said gaseous, said coloring means comprising about 118 parts per million of 1,4-dimethyl-7-(1-methylethyl) azulene and about 5.4 parts per million of 1-phenylazo-2-naphthalenamine.

3. A device consisting of a gas operated cigarette lighter comprising:

a transparent reservoir for containing a pressurized liquid and gaseous fuel selected from the group consisting of naphtha and butane;

hand operated valve means for controllably allowing gaseous fuel to escape to the atmosphere;

ignition means for beginning combustion of said escaping gaseous fuel;

coloring means for said liquid fuel within said transparent reservoir which does not adversely effect the combustion of said gaseous, said coloring means comprising about 1,4-dimethyl-7-(1-methylethyl)azulene, about 5.2 parts per million of 1-phenylazo-2-naphthalenamine, and about 4.4 parts per million of 1-[2,5-dimethyl-4-(2,5-dimethylphenylazo)phenylazo]-2-naphthol.

4. A device consisting of a gas operated cigarette lighter comprising:

a transparent reservoir for containing a pressurized liquid and gaseous fuel selected from the group consisting of naphtha and butane;

hand operated valve means for controllably allowing gaseous fuel to escape to the atmosphere;

ignition means for beginning combustion of said escaping gaseous fuel;

coloring means for said liquid fuel within said transparent reservoir which does not adversely effect the combustion of said gaseous, said coloring means comprising about 92.5 parts per million of 1,4-dimethyl-7-(1-methylethyl)azulene and about 1.3 parts per million of 1-[2,5-dimethyl-4-(2,5-dimethylphenylazo)phenylazo]-2-naphthol.

5. A device consisting of a gas operated cigarette lighter comprising:

a transparent reservoir for containing a pressurized liquid and gaseous fuel selected from the group consisting of naphtha and butane;

hand operated valve means for controllably allowing gaseous fuel to escape to the atmosphere;

ignition means for beginning combustion of said escaping gaseous fuel;

coloring means for said liquid fuel within said transparent reservoir which does not adversely effect the combustion of said gaseous, said coloring means comprising about 311 parts per million of 1,4-dimethyl-7-(1-methylethyl) azulene, about 7.3 parts per million of 1-[2,5-dimethyl-4-(2,5-dimethylphenylazo)phenylazo]-2-naphthol and about 5.2 parts per million of 1-phenylazo-2-naphthalenamine.

* * * * *